United States Patent [19]

Steimle

[11] 4,170,044

[45] Oct. 9, 1979

[54] HYDROTHERAPY APPARATUS AND DUCTING THEREFOR

[76] Inventor: Wayne D. Steimle, 8808 E. Las Tunas Dr., San Gabriel, Calif. 91776

[21] Appl. No.: 604,602

[22] Filed: Aug. 14, 1975

[51] Int. Cl.[2] ..... A61H 33/02; E04H 3/18

[52] U.S. Cl. ..... 4/172.15; 4/172.19; 4/180; 138/178

[58] Field of Search ..... 138/178, 105, 106, 107, 138/172; 4/178, 180, 181, 172.19, 172.15, 172.17; 239/51.5, 77, 270, 271; 128/365, 369, 370

[56] References Cited

U.S. PATENT DOCUMENTS

| | | | |
|---|---|---|---|
| 2,719,307 | 10/1955 | Reid | 4/180 |
| 2,798,768 | 7/1957 | Babin | 405/51 |
| 2,956,565 | 10/1960 | Anderson | 128/369 |
| 3,251,071 | 5/1966 | Wood | 4/180 |
| 3,465,654 | 9/1969 | Fox | 138/157 X |
| 3,903,929 | 9/1975 | Mock | 405/43 |

*Primary Examiner*—Richard E. Aegerter
*Assistant Examiner*—Frederick R. Schmidt
*Attorney, Agent, or Firm*—Sellers and Brace

[57] ABSTRACT

Hydrotherapy apparatus including continuous extruded plastic ducting of keyhole shape in cross-section adapted to be installed in the wall of a water pool and having a multiplicity of air dispensing perforations substantially flush with the interior wall surface. The ducting is readily assembled and installed by unskilled labor in a wide variety of configurations using simple tools and fittings and is connectable to a source of pressurized air.

1 Claim, 4 Drawing Figures

HYDROTHERAPY APPARATUS AND DUCTING THEREFOR

This invention relates to hydrotherapy apparatus and, more particularly, to novel air bubble dispersing ducting adapted to be readily assembled in any desired configuration and installed in the wall of a water pool.

Many proposals have been made heretofore for dispersing air bubbles into pools of water for the many beneficial therapeutic effects obtained in this manner by persons using such pools. Certain of these proposals introduce the air into the pool below the surface level via a single jet or a series of concentrated jets. Others utilize an air distributing manifold embedded in the wall and having a row of air outlets discharging into the water through the pool wall. Either the single or rosette type of air distributor is subject to the serious objection of being restricted to a relatively small area of the pool wall and consequently are useable only by a single bather at any one time. The manifold type air distributors heretofore proposed are time consuming and costly to install and necessitate drilling the perforations through the cementitious material in which the air distributor is embedded while this embedding material is taking a set. The cementitious material conceals the location of the manifold and it not infrequently happens that the holes are bored into the manifold in areas offset from a vertical diametric plane through the manifold. Moreover, it is difficult in practice to obtain a watertight seal between the manifold and the cementitious material. In consequence, the resulting seepage of water causes premature failure and crumbling of the cementitious material with need for expensive repair and maintenance work.

The foregoing and other shortcomings of prior proposals for installing hydrotherapy equipment and apparatus is avoided by the present invention. The novel air distributing ducting is extruded from high strength plastic materials in a configuration assuring effective anchorage and embedment of the ducting in the cementitious material forming the pool wall with a narrow longitudinal portion of the ducting exposed and substantially flush with the interior pool surface. For example, air distributing ducting of keyhole shape in cross-section is found particularly suitable. Straight lengths of this ducting are assembled in any desired configuration with the cylindrical portion of the ducting lowermost and with the slot like portion projecting outwardly through a submerged interior surface of the pool. This narrow exposed portion of the ducting may be left imperforate until installed in the pool wall or if desired it may be pre-perforated and temporarily closed by a removable guard strip which is detached only after the cementitious material has taken a set.

Standard plastic fittings may be employed to interconnect straight sections of the ducting and a specially made closure for the keyhole slot is used in conjunction with these fittings to close off the end of this slot. To safeguard against the possibility of water entering and seeping along the interface between the exterior of the ducting and the cementitious material, the ducting is preferably provided with one or more anchor and sealing flanges projecting laterally from the opposite sides of the slot portion of the ducting.

Accordingly, it is a primary object of the invention to provide an improved and novel hydrotherapy system and apparatus.

Another object of the invention is the provision of extruded plastic ducting of unique shape specially designed for use in a hydrotherapy air distributing network readily assembled by the novice using simple tools and conventional pipe fittings.

Another object of the invention is the provision of extruded plastic ducting of a novel contour and adapted to be embedded in a pool wall and having a perforated wall flush with the interior pool surface.

Another object of the invention is the provision of hydrotherapy air distributing ducting of keyhole shape in cross-section adapted to be provided with one or more rows of air distributing perforations after installation in a pool wall.

These and other more specific objects will appear upon reading the following specification and claims and upon considering in connection therewith the attached drawing to which they relate.

Referring now to the drawing in which a preferred embodiment of the invention is illustrated:

Figure 1:
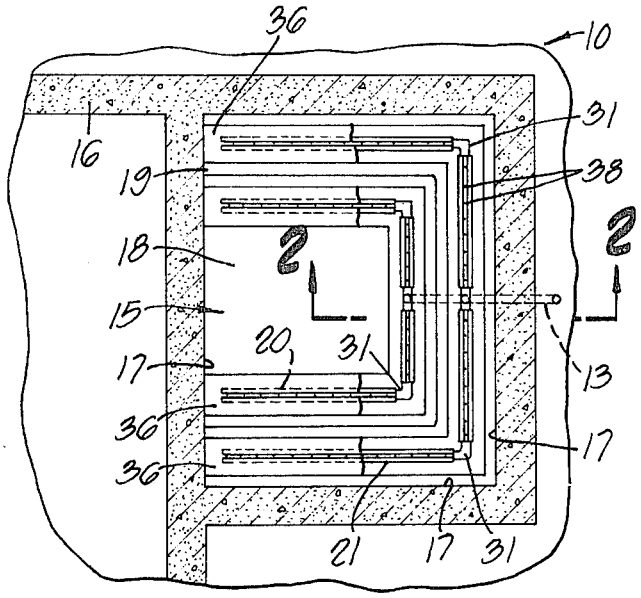
FIG. 1 is a fragmentary horizontal cross-sectional view to a water pool having a typical arrangement of the invention hydrotherapy apparatus installed therein.

As is clearly shown in FIGS. 1–4, the invention hydrotherapy apparatus, designated generally 10, comprises any suitable power-driven blower 11 having an air intake 12 and a pressurized air outlet discharging into the air distributing duct 13. This distributing duct preferably includes an inverted U-shaped trap 14 having its bight portion positioned above the water level in pool 15 thereby safeguarding the blower against entry of water from pool 15.

As herein shown by way of illustration, the water pool 15 is formed as an adjunct to a conventional swimming pool 16 and comprises sidewalls 17 and a bottom wall 18 of cast cement or other suitable watertight material. As here shown, pool 15 includes a bench or seat 19 on which persons using the pool may be seated while enjoying the benefits of hydrotherapy.

Figure 3:
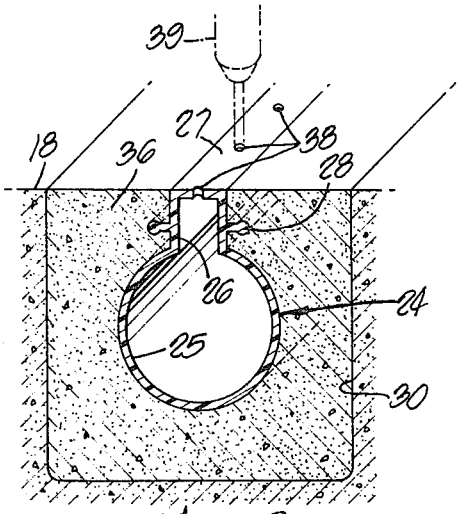
FIG. 3 is a fragmentary cross-sectional perspective view on an enlarged scale showing the ducting installed and the air perforations being bored through the exposed wall thereof.
Figure 2:
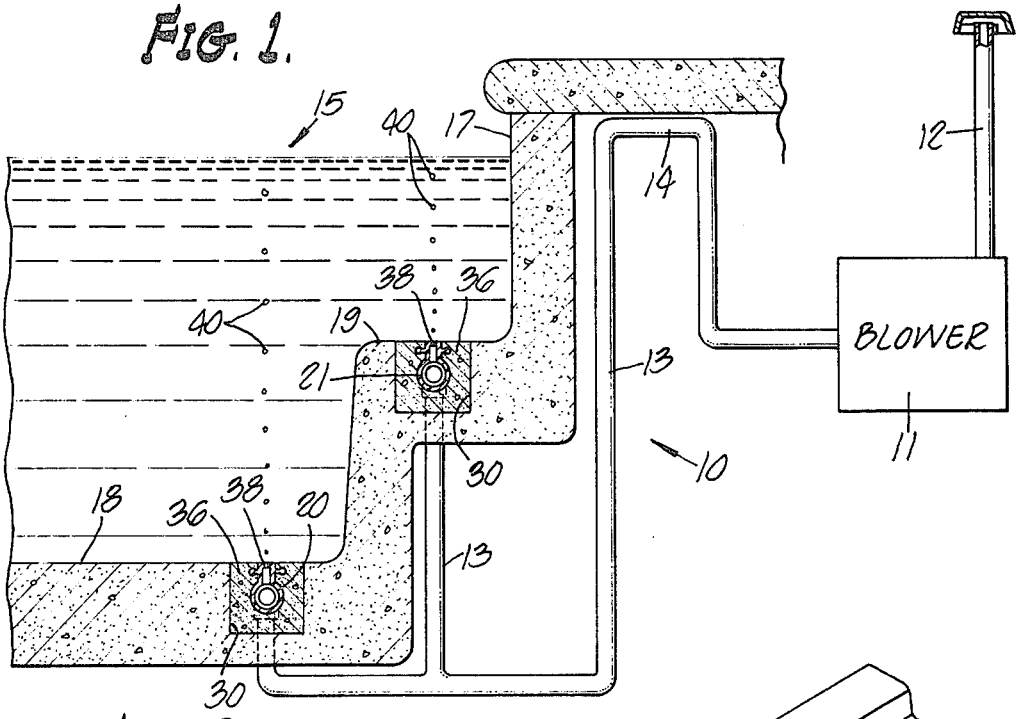
FIG. 2 is a vertical sectional view on an enlarged scale taken along line 2—2 on FIG. 1.
Figure 4:
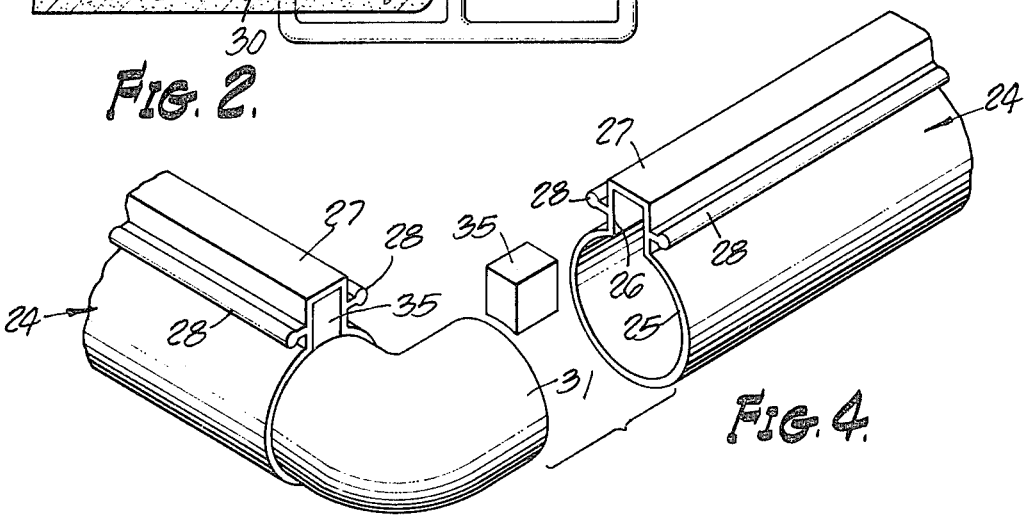
FIG. 4 is an exploded view on an enlarged scale showing an elbow connection and the supplemental closure fitting interconnecting two sections of the ducting arranged at right angles to one another.

The pressurized air distributing duct 13 supplies air to two U-shaped hydrotherapy manifolds 20 and 21. In the illustrative embodiment of these manifolds, each is generally Y-shaped formed from lengths of extruded plastic ducting, the constructional details of which are best shown in FIGS. 3 and 4. Continuous lengths 24 of this ducting are of keyhole shape in cross-section and include a cylindrical main body portion 25 opening radially into a slot-like portion 26 closed across its outer end by a cross-wall 27. Projecting laterally from the exterior sidewalls of the slot portion 26 are sealing ribs or flanges 28,28 to safeguard against seepage of water circumferentially of the ducting and into the cementitious material 36 in which the ducting is usually embedded.

Installation of the air distributing ducting 20,21 is carried out during the construction of the pool walls 17,18. These walls are poured from concrete mix in the usual manner and provided with channels 30 to receive the air distributing ducting 20,21. After the concrete has taken a set the air distributing ducts 20,21 are assembled from lengths of ducting 24. Joints between the adjacent ends of this ducting are interconnected by the usual plastic fittings such as the elbow 31 shown in FIG. 4. The ends of this elbow are sized to have a snug telescopic fit within the adjacent ends of ducting 24. The ends of the elbow preferably taper slightly so as to have a forced or interference fit within the ends of ducting 24 at the final stage of the assembly operation. Before assembly, one or both mating surfaces are coated with adhesive or solvent for the plastic following which the parts are pressed together.

The ends of the keyhole slots 26 are closed with the U-shaped plastic closure members 35 which are cup-shaped and sized to cooperate with adjacent surfaces of elbow fittings 31 and of slot 26 to seal the end of the slot closed. Closure members 35 are held in place by the same adhesive solvent used in assembling the elbows. It will also be understood that the ends of the legs of the U-shaped ducting are closed by end caps of keyhole shape having a snug interference fit with the adjacent interior surfaces.

The mid-length portions of ducting 20,21 also include plastic fittings, such as T-fittings, connecting each of these air distributing ducts with the air supply duct 13. This final assembly operation is carried out with ducting 20,21 supported on the channels 30 of the pool wall following which cementitious material 36 is filled about the ducting and its upper surface is finished flush with the interior walls of the pool and with the cross-wall 27 of the air distributing ducting. Preferably, ducting 20,21 is supported from the bottoms of channel 30 on bosses or the like with wall 27 lying in the plane of the pool wall.

Prior to filling in the material 36, the ducting system is preferably tested either with pressurized water or with pressurized air to make certain that there are no leaks in any of the ducting joints. A final test of a similar nature may be made after the cementitious material 36 is in place and prior to boring the air distributing perforations through cross-wall 27. If no leaks are found, the workman then proceeds to form the perforations 38 at suitable intervals along the cross-wall 27. This is done by a suitable tool, such as a power drill 39.

Following the completion of perforations 38, the system is in readiness for operation. Between periods of operation of blower 11 the water in pool 15 will fill air distributing ducting 13 to a level below water trap 14. This quantity of water is quickly forced out of the ducting upon initiation of the blower operation following which the pressurized air escapes through perforations 38 in a multiplicity of streams of air bubbles 40 which rise vertically to the surface of the water pool and escape into the atmosphere. These streams of bubbles agitate the water and provide a pleasing and beneficial therapeutic effect on the bodies of persons located in the path of the escaping air bubbles. It will be readily apparent that additional air distributing ductings similar to those shown at 20 and 21 may be installed as desired in the walls of the water pool. If desired, manually operable valves may be located in the supply ducts 13 permitting the user to open or close selected ones of these valves to control the points at which the air bubbles are discharged into the water of pool 15. Regardless of where the ducting 24 is positioned, it will be apparent that no portion extends beyond the interior surface of the pool wall thereby avoiding any possibility of injury to persons using the pool and yet providing for the discharge of a multiplicity of streams of bubbles from areas flush with the interior wall surfaces.

If preferred, the air distributing perforations 38 may be formed in cross-wall 27 prior to installation of the distributing ducts in the cementitious material. In this event, the perforations are preferably closed against the possibility of entry of foreign matter during installation by strips of protective taping coated with pressure sensitive adhesive which taping remains in place until installation of the equipment has been completed and it is ready for use. At that time the strips are quickly detached by peeling them progressively from the cross-wall thereby exposing perforations 38.

While the particular hydrotherapy apparatus and ducting therefor herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

I claim:

1. Hydrotherapy apparatus for bubbling air outwardly into the water of a hydrotherapy pool from a multiplicity of round air discharge perforations, said apparatus comprising ducting of keyhole shape in cross section and including a cylindrical portion opening radially into a slot-like portion having a bottom formed by a cross wall, said ducting being adapted to be embedded in cementitious material except for said cross wall which is left exposed and generally flush with a submerged interior surface of the hydrotherapy pool walls and with the remainder of said ducting permanently embedded in said cementitious material, said cross wall of said slot-like portion of said ducting being imperforate when installed and being thereafter provided with a multiplicity of round air discharge perforations for dispersing bubbles of air outwardly into the pool water, said ducting being closed except for said air discharge perforations and in communication with a source of pressurized air via duct means opening into a midlength portion of said air dispensing ducting and having a portion thereof located above the water level in said pool, and a portion of said air dispensing ducting being embedded in the bottom wall of said pool and another portion thereof being embedded in a seat portion of the pool wall.

* * * * *